United States Patent [19]

Nishioka

[11] Patent Number: 5,012,605

[45] Date of Patent: May 7, 1991

[54] TRIGGER COVER

[76] Inventor: Jim Z. Nishioka, 1268 Hemlock NW., Salem, Oreg. 97304

[21] Appl. No.: 425,283

[22] Filed: Oct. 23, 1989

[51] Int. Cl.[5] ..... F41A 17/02

[52] U.S. Cl. ..... 42/70.07; 42/70.11

[58] Field of Search ..... 42/70.01, 70.07, 70.11, 42/83

[56] References Cited

U.S. PATENT DOCUMENTS

| | | |
|---|---|---|
| 955,237 | 4/1910 | Westcott et al. . |
| 1,513,267 | 10/1924 | Parks . |
| 1,569,553 | 1/1926 | Lewis et al. . |
| 1,686,482 | 10/1928 | Windle . |
| 1,887,308 | 11/1932 | Jessup . |
| 2,080,202 | 5/1937 | Drake . |
| 2,401,482 | 6/1946 | Hendey . |
| 2,444,649 | 7/1948 | Jacobs . |
| 2,590,516 | 3/1952 | De Von Breymann . |
| 2,599,132 | 6/1952 | Sass . |
| 2,664,658 | 1/1954 | Bjorklund . |
| 2,709,865 | 6/1955 | Bohenek . |
| 2,742,726 | 4/1956 | Feller . |
| 2,859,551 | 11/1958 | Buchanan . |
| 2,882,636 | 4/1959 | Shinaver . |
| 3,020,663 | 2/1962 | Newson . |
| 3,022,596 | 2/1962 | Cannon . |
| 3,064,383 | 11/1962 | Newson, Sr. . |
| 3,066,433 | 12/1962 | Rogers et al. . |
| 3,164,919 | 1/1965 | Hall . |
| 3,269,046 | 8/1966 | Schaefer . |
| 3,442,560 | 1/1969 | Foote . |
| 3,616,559 | 11/1971 | Sobolewski . |
| 3,711,979 | 1/1973 | Small . |
| 3,956,842 | 5/1976 | Ballenger . |
| 4,030,221 | 6/1977 | Doobenen et al. . |
| 4,395,837 | 8/1983 | Durnal . |
| 4,499,681 | 2/1985 | Bako . |
| 4,509,281 | 4/1985 | Dreiling et al. . |
| 4,644,676 | 2/1987 | Stern . |

FOREIGN PATENT DOCUMENTS

| | | | |
|---|---|---|---|
| 117 | 8/1899 | Austria | 42/70.07 |
| 350867 | 6/1905 | France | 42/70.07 |

*Primary Examiner*—Charles T. Jordan
*Assistant Examiner*—Richard W. Wendtland

[57] ABSTRACT

A trigger cover for covering a trigger of a gun is provided. The cover includes an open and a closed position. The open position of the cover being for exposing the trigger and the closed position of the cover being for covering and restricting access to the trigger. The cover is pivotably connected to the gun by a shaft which extends through such gun. The shaft allows the cover to be pivoted from the closed position to the open position. The cover is connected to the gun in both the open and the closed positions of the cover.

12 Claims, 2 Drawing Sheets

TRIGGER COVER

This invention relates to new and useful improvements in trigger covers for shooting devices.

SUMMARY OF THE INVENTION

According to the present invention and forming primary objectives thereof, a trigger cover for shooting devices is provided having novel structural arrangements.

Prior trigger covers are shown in U.S. patents which are removed from the shooting device when not in use. Examples of such devices are shown in the following U.S. Pat. Nos.: 4,499,681, Bako et al., Feb. 19, 1985; 3,956,842, Ballenger, May 18, 1976; and 3,422,560, Foote et al, Jan. 21, 1969. A trigger lock is shown in U.S. Pat. No. 3,722,979, Small, Jan. 23, 1973. This device clamps on the trigger guard and locks the trigger to prevent its movement. However, the trigger remains exposed.

An objective of the present invention is to provide a cover for preventing unauthorized use of the shooting device and also to help prevent accidental discharge of the device.

The cover includes an open or operative position to expose and allow use of the trigger and a closed or non-operative position to restrict access to and operation of the trigger. The cover remains on the shooting device in both the open and the closed positions of such cover.

Another objective of the present invention is to provide a shooting device with a grip portion which is recessed to receive the cover when the latter is in the open position.

The invention will be better understood and additional objectives and advantages will become apparent from the following description taken in connection with the accompanying drawings.

DETAILED DESCRIPTION OF PREFERRED EMBODIMENTS

Figure 1:
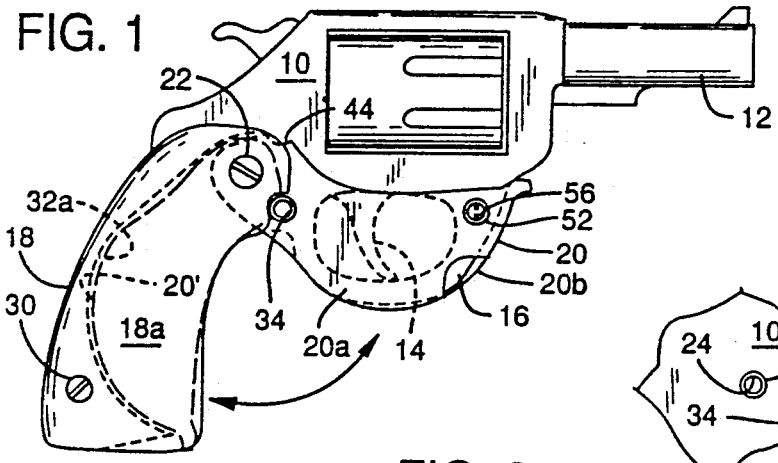
FIG. 1 is a side elevational view of a first form of a gun and a trigger cover embodying principles of the present invention.
Figure 6:
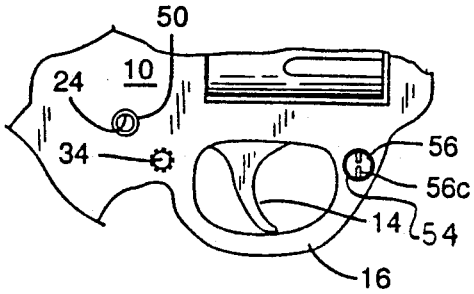
FIG. 6 is a fragmentary view of a trigger portion of the gun.
Figure 9:
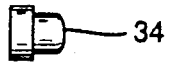
FIG. 9 is an isolated view of the detent shown in FIG. 7.

With reference to the drawings and first to FIGS. 1-12, a first embodiment of the present invention embodying principles of the present invention is shown. A gun 10 includes a barrel 12, a trigger 14, a trigger guard 16 and a grip 18. The grip includes a pair of side portions **18*a* and 18*b*, best seen in FIG. 5**.

A cover 20 is pivotably connected to the gun 10 by a bolt 22. The bolt extends through an aperture 24, best seen in FIG. 6, and through another aperture 28 which extends through the cover 20, best seen in FIG. 3. The side portions **18*a* and 18*b* of the grip 18 are held in place by a bolt 30 and the bolt 22**.

The cover 20, shown in FIG. 1, is in a closed or inoperative position which covers the trigger 14 to restrict access to and operation of such trigger. The cover can be pivoted rearwardly and downwardly to an open or operative position which is indicated by a broken line 20'. Such open position exposes the trigger and allows normal operation of the gun. The cover can be pivoted forwardly and upwardly from the open position to the closed position.

Figure 3:
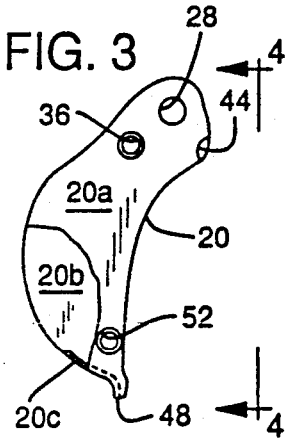
FIG. 3 is a side elevational view of the cover shown in FIG. 1.
Figure 4:
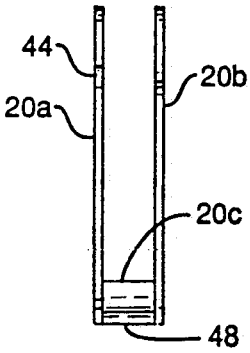
FIG. 4 is a view of the cover shown in FIG. 3 taken on lines 4—4.
Figure 5:
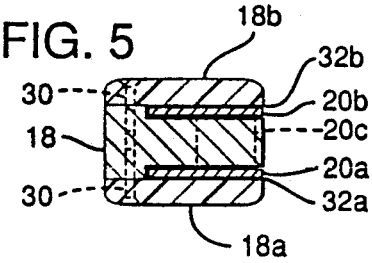
FIG. 5 is a sectional view of the grip shown in FIG. 2 taken on lines 5—5.

The cover includes a pair of opposite parallel side walls **20*a* and 20*b* which are connected by a connecting wall 20*c*, best seen in FIGS. 3 and 4. In the open or operative position of the cover, the side walls 20*a* and 20*b* extend into a pair of recesses 32*a* and 32*b* in the grip 18. Such positioning of the walls in the recesses is shown in FIG. 5**.

The cover 20 is contoured to generally correspond to the contour of the grip 18 to provide a comfortable gripping area for the operator. In the open position, the cover is substantially hidden and provides a clean profile for the gun. This can be seen in FIG. 2.

Figure 7:
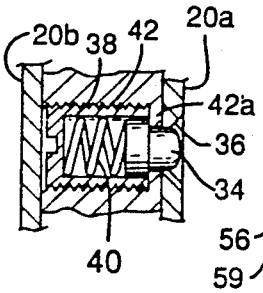
FIG. 7 is an enlarged sectional fragmentary view of a detent and related structure.
Figure 8:
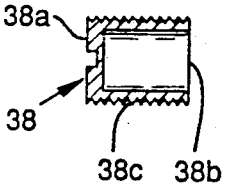
FIG. 8 is an isolated view of the hollow threaded plug shown in FIG. 7.

A detent 34, best seen in FIG. 7, extends through an aperture 36 in the wall **20*a* of the cover 20. The detent is supported by a hollow threaded plug 38. Such plug includes a closed end 38*a*, an open end 38*b* and a threaded portion 38*c*. The plug receives a spring 40 and the detent 34. A threaded aperture 42 in the gun 10 receives the plug. Such aperture includes an inwardly extending portion 42*a* which limits the outwardly movement of the detent. The detent is positioned below the bolt 22**.

It can be seen that the detent 34 holds the cover 20 in the closed position due to its engagement with the aperture 36. Furthermore, it can be seen that by depressing the detent against the resistance of the spring 40, the cover 20 can be pivoted to the open position indicated by the broken line 20'.

Figure 2:
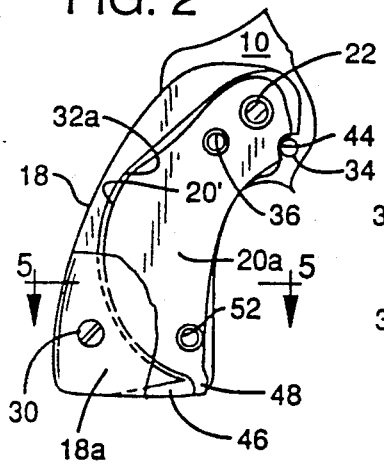
FIG. 2 is a side elevational view of a grip of the gun shown in FIG. 1 with part of the grip cover broken away.

Furthermore, when the cover 20 is positioned in the open or operative position indicated by the broken line 20' in FIG. 1 and shown in FIG. 2, the detent 34 engages an aperture 44 in the wall **20*a* of the cover 20**. This engagement of the detent with such aperture holds the cover in the open position and restricts movement of the cover when the gun is jarred by recoil.

When the cover 20 is pivoted to either the open or the closed positions, the detent 34 will automatically engage the corresponding aperture due to the constant pressure of the spring 40 on the detent.

Furthermore, the tension required to depress the detent 34 against the spring 40 may be increased as a further deterrent against children accidentally discharging the gun.

A groove 46, positioned on the bottom of the grip 18, best seen in FIG. 2, provides a convenient access to the cover 20 when moving the latter from the open position to the closed position. The cover includes an extension 48 for easy grasping. A shoulder 50 surrounds the aperture 24, best seen in FIG. 6, and prevents binding of the cover when the bolt 22 is tightened.

The wall 20*a* of the cover 20 includes another aperture 52 for holding and locking the cover in the closed or inoperative position. An aperture 54 in the gun 10, best seen in FIG. 10, receives a shaft 56. The aperture 54 includes a threaded portion 54*a*. The shaft includes a threaded portion 56*a* which engages the threaded portion 54*a* of such aperture. The shaft also includes an enlarged head 56*b*. The aperture 54 has a corresponding enlarged portion 56*b* which allows limited movement of such shaft. The enlarged head 56*b* is larger in diameter than the aperture 52 which restricts outwardly movement of the shaft. The shaft extends through an aperture 59 in the wall 20*b* of the cover 20. The shaft is positioned forwardly of the bolt 22.

Figure 10:
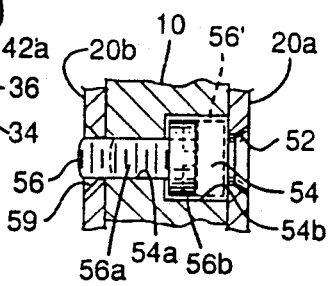
FIG. 10 is an enlarged sectional view of a holding structure.
Figure 11:
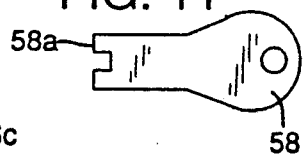
FIG. 11 is a view of a key or tool for activating the structure shown in FIG. 10.

A key 58, seen in FIG. 11, is provided to activate the shaft 56 shown in FIG. 10. A front end 58*a* of the key includes a configuration to correspond to a recessed configuration 56*c* in the enlarged head 56*b* of the shaft 56. Such configuration will discourage unauthorized use of the gun. This key mechanism may be employed as an optional deterrent in addition to the detent shown in FIG. 7.

When the shaft 56 is fully tightened, the end of such shaft will extend into the aperture 59 to provide easy visual indication that the cover is firmly held and locked. Furthermore, the operator can easily feel the end of such shaft when the latter is in the locked position.

To operate the embodiment shown in FIGS. 1–12, the key 58 is inserted into the aperture 52 in the cover 20 and engaged to the shaft head 56*b*. Since the configuration of the key end 58*a* will correspond to the configuration 56*c* in the head of the shaft, such shaft can be activated. The shaft is rotated in a counterclockwise movement until it backs clear of the aperture 59 in the wall 20*b* of the cover. Then the detent 34 is depressed against the resistance of the spring 40 so that it clears the aperture 36. This allows the cover to be pivoted downwardly and rearwardly to the open or operative position indicated by the broken line 20' and shown in FIG. 2.

When the cover 20 is pivoted to the open position it exposes the trigger 14 and allows normal operation of the gun 10. In the open position the detent 34 engages the aperture 44 and holds the cover in place.

To move the cover 20 back to the closed position the operator depresses the detent 34. This will clear the detent from the aperture 44 and allow the cover to be pivoted forwardly and upwardly to the closed position. The detent will engage the aperture 36 in the wall 20*a* and hold or lock the cover in the closed or inoperative position. Optionally, the shaft 56 can be activated by the key 58 and rotated in a clockwise direction to engage such shaft to the aperture 59 in the wall 20*b*. This, in addition to the detent, will hold or lock the cover in the closed or inoperative position.

The sequence of actions required to move the cover from the closed position to the open position makes it difficult for children to operate the gun. This is an important safety feature of the disclosure.

The detent 34 may be employed without using the shaft 56 or both the detent and the shaft may be employed.

Figure 12:
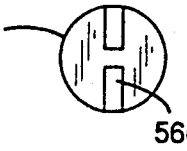
FIG. 12 is a view of a configuration on the head of the shaft shown in FIG. 10.

The complexity of the configurations 58*a* and 56*c*, shown in FIGS. 11 and 12, respectively, may be increased to make it more difficult to activate the shaft by unauthorized persons.

The cover 20, shown in FIG. 1, remains on the gun 10 in both the closed and open positions. This is an important convenience feature which promotes frequent use of the cover.

Furthermore, the fact that the cover 20 remains on the gun 10 reduces possibility of misplacing or losing such cover.

The open and closed positions of the cover 20 shown in FIG. 1 are highly visible, therefore, it is easy to see what mode the cover is in. This is a desirable feature.

Referring to FIGS. 13–16 there is shown a second embodiment disclosing principles of the present invention. A gun 60 includes a stock 62 which includes a grip portion 62*a*, a forward portion 62*b* and a butt portion 62*c*. The gun also includes a trigger guard 64 and a trigger 66.

Figure 15:
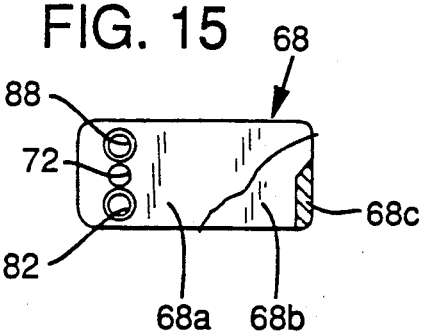
FIG. 15 is an isolated view of the cover shown in FIG. 13.

A cover 68 includes opposite parallel side walls 68*a* and 68*b* and a connecting wall 68*c*, best seen in FIG. 15. The cover is pivotably connected to the trigger guard 64 by a bolt 70, best seen in FIG. 16. The bolt extends through an aperture 72 in the cover and through another aperture 74 which extends through the trigger guard.

The cover 68 is shown in a closed or non-operative position which covers and restricts access to the trigger 66. An open or operative position of the cover, which exposes the trigger and allows its operation, is indicated by a broken line 68'.

The cover 68 is held in the closed position by a detent 76 which is received by an aperture 78 in the trigger guard 64. The aperture 78 is closed on one end and receives a spring 80. The spring urges the detent so that a portion of such detent extends through an aperture 82 in the wall 68*a*. This holds the cover in the closed position. The detent is positioned below the bolt 70.

A shaft 84 is received by an aperture 86 in the trigger guard 64. Such aperture includes a threaded portion 86*a* which engages a threaded portion 84*a* of the shaft. The shaft is positioned above the bolt 70. The aperture includes an enlarged portion 86*b* which allows an enlarged head 84*b* of the shaft to move laterally when such shaft is activated. The shaft extends through an aperture 90 in the wall 68*b*. This holds and locks the cover 68 in the closed position. The shaft head 84*b* includes a configuration 84*c* for receiving a tool for activating the shaft.

The embodiment shown in FIGS. 13–16 is similar to the first embodiment shown in FIGS. 1–12, however, the cover 68 is positioned outside of the gun 60 in both the open and the closed positions. This simplifies the manufacture of the gun and can be readily adapted to existing product lines.

This embodiment functions in a manner similar to that shown in FIG. 1. A tool is inserted in the aperture 88 and engaged to the head 84*b*. The shaft 84 is then backed out of the aperture 90 which releases the shaft's hold on the cover. Then the detent 76 is depressed away from the aperture 82. The cover 68 now can be pivoted downwardly and forwardly to the open or operative position indicated by the broken line 68'. When the cover is pivoted to the open position the detent will enter the aperture 88 to hold the cover.

To return the cover 68 back to the closed position, the detent 76 is depressed and the cover is pivoted downwardly and rearwardly. The detent, under pressure from the spring 80, will enter the aperture 82 when the cover is in the closed position.

Figure 16:
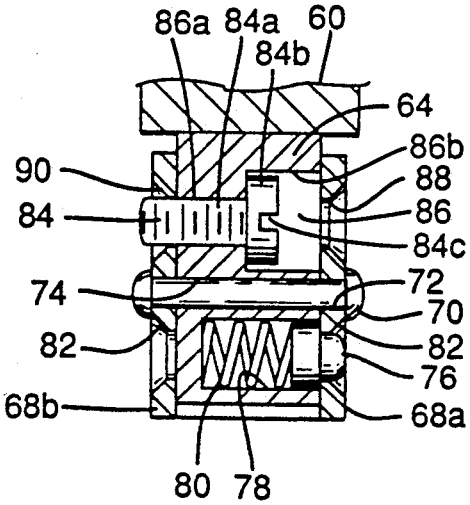
FIG. 16 is an enlarged fragmentary sectional view taken on lines 16—16 of FIG. 13.

The detent 76 and the shaft 84, shown in FIG. 16, provide substantially the same advantages as the detent 34 and the shaft 56 shown in FIG. 10.

Figure 13:
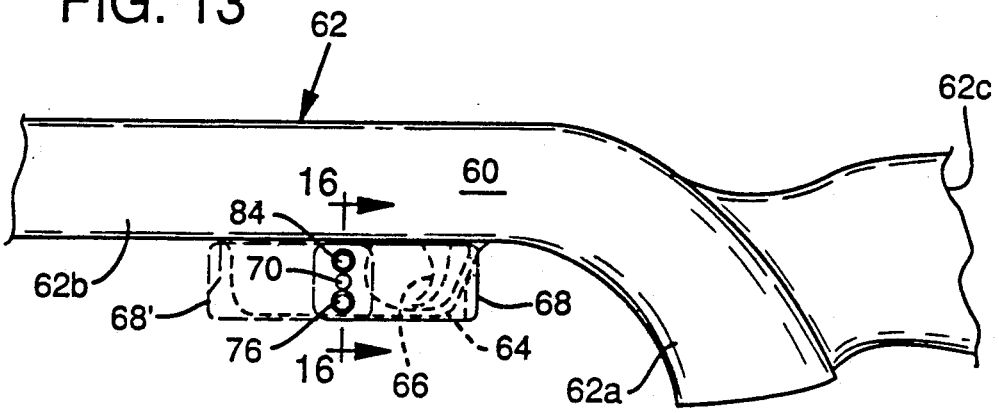
FIG. 13 is a side elevational view of a gun and a trigger cover embodying principles of the present invention.

The cover 68, in the open position indicated by the broken line 68' and best seen in FIG. 13, is positioned in front of the trigger 66 and extends forwardly in a shooting direction of the gun 60.

Figure 14:
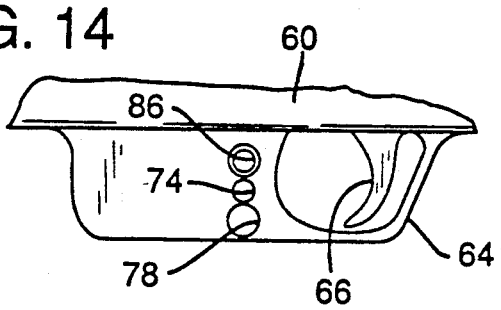
FIG. 14 is a fragmentary side elevational view of the trigger guard and trigger shown in FIG. 13.

The trigger guard 64 includes a forwardly extending extension portion which helps to stabilize the cover 68 when the latter is in the open position indicated by the broken line 68', best seen in FIG. 13. The extension portion also is shown in FIG. 14. The extension portion is positioned forwardly of the trigger 66, the bolt 70 and the aperture 72. The cover 68, best seen in FIG. 15, has a front to back length. The extension portion of the trigger guard 64 extends along a substantial portion of the front to back length of the cover when the latter is in the open position indicated by the broken line 68'.

While the above description contains many specifics, the reader should not construe these as limitations on the scope of the invention, but merely as examples of the preferred embodiments thereof. Alternate constructions and modifications include the following:

The covers shown in this disclosure are pivotably connected, however, other methods of connecting may be employed. An example is to provide a cover with a pair of flat parallel walls connected by a pair of wall portions on opposite ends of the walls. The top and bottom of the cover would be open to allow such cover to slip over the trigger guard. A vertically extending slot in the parallel walls would slidably receive a threaded bolt which would allow the cover to slide up and down within the limits of the bolt in the slot. The bolt would be connected to the trigger guard by a threaded aperture in such guard. The operator could hold the cover in an open or up position by tightening the bolt. Similarly, the operator could hold the cover in a closed or down position by tightening the bolt.

Another alternate construction is to provide a pair of flat individual walls to be positioned on opposite sides of the trigger guard to cover the trigger. Such walls would be hinged above the trigger to pivot downwardly to cover the trigger and pivot upwardly to expose the trigger. The walls can be spring loaded to stay in the upwardly position. A bolt or other device may be employed to hold the walls in the downwardly position. The stock can be recessed to receive the walls in the upwardly position. Furthermore, the walls may be hinged forwardly of the trigger and pivot horizontally. Such walls would pivot rearwardly to cover the trigger and pivot forwardly to uncover such trigger. Bolts or other devices may be employed to hold the walls in the forward or the rearward positions.

Single detents are shown in FIGS. 7 and 16, however, a pair of opposing detents may be employed.

The grip 18 shown in FIG. 1 includes recesses 32*a* and 32*b* which receive the cover 20. The grip 62*a* shown in FIG. 13 can be designed to include similar recesses to receive a cover which would function in a manner similar to the cover 20.

The cover 68, shown in FIG. 15, may include devices such as raised portions, knobs, handles, extensions or the like, for grasping by the operator during pivoting movements of the cover.

The cover 20 and the trigger guard 16 shown in FIG. 1 and the cover 68 and the trigger guard 64 shown in FIG. 13 are connected to the respective shooting devices, however, such covers or trigger guards may be manufactured separately and added as after-market products.

The embodiment shown in FIG. 13 may be modified to be used with handguns which employ magazines in the grip portions.

Spring-loaded detents and key locks are shown in this disclosure, however, other devices such as spring-loaded latches or the like may be employed which perform the same function.

The concept disclosed in this application may be employed with the guns shown or employed with other shooting devices such as crossbows, spear guns or the like.

The aperture 44 shown in FIG. 2 is optional. The detent can directly engage the cover 20 and hold such cover in the open position.

The detents and the tool-activated shafts, shown in FIGS. 1 and 13, may be positioned on the guns in different locations. Furthermore, the positions of such detents and such shafts may be reversed.

Referring to FIG. 1, the preferred method of moving the cover 20 from position to position is to pivot such cover. However, the same positioning of the cover may be accomplished by disconnecting the cover and then reconnecting such cover in a different position.

Having thus described my invention, I claim:

1. In combination, a trigger cover and a gun, said gun including a trigger, a trigger guard and a grip portion for gripping by an operator to grip during operation of the gun, said trigger cover including cover means, said cover means including an open position and a closed position, said open position being a position of said cover means for exposing said trigger and allowing access to and operation of the latter, said closed position being a position of said cover means for covering and restricting access to said trigger, said trigger cover also including connecting means for connecting said cover means to said gun, said connecting means connecting said cover means to said gun when said cover means is in said closed position for covering and restricting access to said trigger, said connecting means also connecting said cover means to said gun when said cover means is in said open position for exposing and allowing operation of said trigger, said gun also including recess means for receiving at least a portion of said cover means during operation of said trigger cover, said recess means being positioned in said grip portion of said gun.

2. The combination of claim 1 wherein said cover means includes a pair of parallel walls for covering said trigger, said walls extending into said recess means during operation of said trigger cover.

3. The combination of claim 1 wherein said grip portion includes opposite side portions, said recess means being positioned between said opposite side portions.

4. The combination of claim 1 wherein said grip portion includes a forwardly facing side which is positioned adjacent to said trigger and said recess means extends through said forwardly facing side of said grip portion to receive said cover means during operation of said combination.

5. The combination of claim 1 wherein at least a portion of said recess means is positioned below said trigger guard.

6. The combination of claim 1 wherein said gun includes groove means for providing the operator access to said cover means for moving said cover means from said open position to said closed position, said groove means being positioned in said grip portion adjacent to said recess means.

7. In combination, a trigger cover and a gun, said gun including a trigger and a trigger guard, said trigger cover for providing a safety cover for said trigger when said gun is not in use, said trigger cover including cover means, said cover means including an open position and a closed position, said open position being a position of said cover means for exposing said trigger and allowing access to and operation of the latter, said closed position being a position of said cover means for covering and restricting access to said trigger, said trigger cover also including connecting means for connecting said cover means to said gun, said connecting means connecting said cover means to said gun when said cover means is in said closed position for covering and restricting access to said trigger, said connecting means also connecting said cover means to said gun when said cover means is in said open position for exposing and allowing operation of said trigger, said gun also including a grip portion, said grip portion being contoured for comfortable gripping by an operator, said cover means being contoured to generally correspond to the contour of said grip portion when said cover is in said open position.

8. In combination, a trigger cover and a gun, said gun including a trigger and a trigger guard, said trigger cover for providing a safety cover for said trigger when said gun is not in use, said trigger cover including cover means, said cover means including an open position and a closed position, said open position being a position of said cover means for exposing said trigger and allowing access to and operation of the latter, said closed position being a position of said cover means for covering and restricting access to said trigger, said trigger cover also including connecting means for pivotably connecting said cover means to said gun, said combination also including holding means for controlling pivoting movements of said cover means, said holding means including first and second positions, said first position of said holding means allowing said cover means to be pivoted downwardly and below said trigger, said second position of said holding means for stopping upwardly pivoting movements of said cover means towards said trigger when the latter is in said open position, said holding means being releasable from said second position to said first position by the operator, said holding means including a pair of apertures in said cover means for holding said cover means in said open and closed positions.

9. The combination of claim 8 wherein said pair of apertures in said cover means includes a first aperture positioned above said connecting means and a second aperture positioned below said connecting means.

10. In combination, a trigger cover and a gun, said gun including a barrel a trigger and a trigger guard, said trigger cover for providing a safety cover for said trigger when said gun is not in use, said trigger cover including cover means having a longitudinal axis, said cover means being rotatable between, an open position and a closed position, said open position being a position of said cover means for exposing said trigger and allowing access to and operation of the latter, said closed position being a position of said cover means for covering and restricting access to said trigger, and in both said open position and said closed position, the longitudinal axis of the cover plate is parallel to the barrel, said trigger cover also including connecting means for connecting said cover means to said gun, said connecting means connecting said cover means to said gun when said cover means is in said closed position for covering and restricting access to said trigger, said connecting means also connecting said cover means to said gun when said cover means is in said open position for exposing and allowing operation of said trigger, said connecting means allowing the operator to move said cover means from said closed position to said open position, said cover means, when in said open position, is positioned forwardly of said trigger and extends forwardly away from said trigger in a shooting direction of the gun.

11. The combination of claim 10 wherein said combination includes holding means to hold said cover means in said open position in front of said trigger, both said connecting means and said holding means being positioned forwardly of an in horizontal alignment with said trigger.

12. The combination of claim 10 wherein said cover means includes a pair of parallel walls for covering said trigger, said pair of parallel walls including a front to back length, said trigger guard including extension means for stabilizing said pair of parallel walls when the latter is in said open position and extending forwardly in a shooting direction of the gun, said extension means being positioned forwardly of said trigger and extending forwardly in the shooting direction of the gun, said extension means extending along a substantial portion of said front to back length of said pair of parallel walls when the latter is in said open position.

* * * * *

UNITED STATES PATENT AND TRADEMARK OFFICE

CERTIFICATE OF CORRECTION

PATENT NO. : 5,012,605

DATED : May 7, 1991

INVENTOR(S) : Jim Z. Nishioka

It is certified that error appears in the above-identified patent and that said Letters Patent is hereby corrected as shown below:

Col. 8, claim 10, line 22, delete "," (comma).

Col. 8, claim 11, line 51, change "an" to --and--.

Signed and Sealed this

Eighth Day of September, 1992

*Attest:*

DOUGLAS B. COMER

*Attesting Officer*

*Acting Commissioner of Patents and Trademarks*